US007033229B2

(12) United States Patent
Tsuchiya

(10) Patent No.: US 7,033,229 B2
(45) Date of Patent: Apr. 25, 2006

(54) TERMINAL FITTING AND A CONNECTOR

(75) Inventor: Takashi Tsuchiya, Yokkaichi (JP)

(73) Assignee: Sumitomo Wiring Systems, Ltd., (JP)

( * ) Notice: Subject to any disclaimer, the term of this patent is extended or adjusted under 35 U.S.C. 154(b) by 0 days.

(21) Appl. No.: 11/036,292

(22) Filed: Jan. 14, 2005

(65) Prior Publication Data

US 2005/0159038 A1 Jul. 21, 2005

(30) Foreign Application Priority Data

Jan. 16, 2004 (JP) ..... 2004-009622

(51) Int. Cl.
*H01R 13/40* (2006.01)

(52) U.S. Cl. ..... 439/733.1

(58) Field of Classification Search ..... 439/733.1, 439/869, 603, 78, 79, 80
See application file for complete search history.

(56) References Cited

U.S. PATENT DOCUMENTS 6,152,782 A * 11/2000 Volkert et al. ..... 439/733.1
6,328,576 B1 * 12/2001 Takahashi ..... 439/78
6,520,788 B1 * 2/2003 Ichida et al. ..... 439/271
6,786,777 B1 * 9/2004 Sakatani ..... 439/677
6,811,449 B1 * 11/2004 Yamashita ..... 439/733.1
2004/0180582 A1 * 9/2004 Nakamura ..... 439/733.1
2004/0219841 A1 * 11/2004 Yamashita ..... 439/733.1

FOREIGN PATENT DOCUMENTS

JP 61-60486 4/1986

* cited by examiner

*Primary Examiner*—Phuong Dinh
(74) *Attorney, Agent, or Firm*—Gerald E. Hespos; Anthony J. Casella

(57) ABSTRACT

A connector (10) has a housing (12) with insertion holes (15) and terminal fittings (20) to be pressed into the insertion holes (15). Each terminal fitting (20) has a press-in portion (23) to be pressed into the insertion hole (15) while pushing material of the housing (12) outward. An accommodating portion (24) is continuous with the press-in portion (23) and has slanted surfaces (24A) narrowing the press-in portion (23) toward the rear side with respect to the inserting direction. Thus, material pushed out by the press-in portion (23) returns after the passage of the press-in portion (23) and engages the accommodat9ing portion (24). The width between the rear ends of the slanted surfaces (24A) of the accommodating portion (24) is equal to or smaller than the width of the insertion hole (15).

17 Claims, 8 Drawing Sheets

TERMINAL FITTING AND A CONNECTOR

BACKGROUND OF THE INVENTION

1. Field of the Invention

The invention relates to a terminal fitting, to a connector provided therewith and to a method of assembling such connector.

2. Description of the Related Art

Japanese Utility Model Publication No. S61-60486 and FIG. 8 herein disclose a known connector that can be mounted on a printed circuit board. With reference to FIG. 8, the connector has a housing 1 made of a synthetic resin. The housing 1 has opposite front and rear ends, and a receptacle is formed at the front end for receiving a mating connector. Through holes extend through the housing 1 from the receptacle to the rear end of the housing 1. Terminal fittings 2 extend through the through holes so that front ends of the terminal fittings 2 extend into the receptacle. Rear ends of the terminal fittings 2 project from the rear of the housing 1 and towards the circuit board.

The terminal fittings 2 have press-in portions that are larger than the through holes. The press-in portions typically were used to press the terminal fittings 2 from the front and through the through holes of the housing 1.

Terminal fittings 2 recently have been pressed forward from the rear of the housing 1 to simplify production processes and to use the same automated facilities for several different connectors. However, terminal fittings pressed from the rear of the housing, may not exhibit a sufficient terminal holding force during connection of the male and female housings against a pressure acting in the withdrawing direction of the terminal fittings.

A larger press-in portion has been considered to increase the terminal forcing force. However, the larger press-in force leads to a larger compressive stress on the housing, and might cause a crack in the housing.

The present invention was developed in view of the above problem and an object thereof is to prevent the withdrawal of terminal fittings.

SUMMARY OF THE INVENTION

The invention relates to a terminal fitting to be pressed into an insertion hole of a housing of a connector. The terminal fitting includes an inserting portion with a press-in portion to be pressed into the insertion hole. The press-in portion is dimensioned to generate outward deformation of material defining the insertion hole. The inserting portion also has an accommodating portion substantially continuous with the press-in portion. The accommodating portion has at least one slanted surface that narrows the press-in portion toward its rear side with respect to an inserting direction. Thus, the material deformed by the press-in portion can at least partly return after the press-in portion has passed to engage the accommodating portion. Thus, the returned material engages the accommodating portion to prevent the withdrawal of the terminal fitting even if a pressure acts on the terminal fitting in withdrawing direction.

The width of each terminal fitting at the rear end of the accommodating portion preferably is equal to or smaller than the width of the insertion hole.

The slanted surface of the accommodating portion preferably extends substantially up to the entrance of the insertion hole. A slanted surface that terminated at an intermediate position of the insertion hole would be steeper and a larger clearance would exist between the returned material and the slanted surface. Thus, the returned material would not catch the accommodating portion sufficiently to resist pressure on the terminal fitting in the withdrawing direction. However, the slanted surface of the accommodating portion preferably extends substantially up to the entrance of the insertion hole, and is sloped moderately. Therefore, the accommodating portion is caught sufficiently by the returned material to prevent the withdrawal of the terminal fitting when a pressure acts on the terminal fitting in withdrawing direction.

The terminal fitting may have two slanted surfaces that narrow the press-in portion toward its rear side with respect to inserting direction.

The terminal fitting preferably has a bulge for contacting a stepping surface of the housing to restrict insertion of the terminal fitting to a proper depth in the insertion hole. The bulge preferably is formed with at least one biting projection for biting in the stepping surface to deform the material near the accommodating portion towards the accommodating portion.

The invention also relates to a connector with a housing and at least one insertion hole that penetrates the housing. The above-described terminal fittings is pressed into the insertion hole from an insertion side of the housing.

The housing preferably comprises a receptacle for receiving a mating connector, and the insertion hole penetrates a back wall of the housing.

Preferably, the slanted surface of each accommodating portion extends up the entrance of the insertion hole.

The housing preferably has a stepping surface for extending the entrance of each insertion hole.

These and other features of the invention will become more apparent upon reading of the following detailed description of preferred embodiments. It should be understood that even though embodiments are separately described, single features thereof may be combined to additional embodiments.

DETAILED DESCRIPTION OF THE PREFERRED EMBODIMENTS

A connector in accordance with the invention is identified by the numeral 10 in FIGS. 1 to 7. The connector 10 is configured for mounting on a printed circuit board (not shown) or some other electric or electronic device. In the following description, an end of the connector 10 that mates with an unillustrated mating connector (left side in FIG. 1) is referred to as the front and reference is made to FIG. 1 concerning the vertical direction. The terms upper and lower are used herein as a convenient frame of reference, but are not intended to imply are required gravitational orientation.

Figure 1:
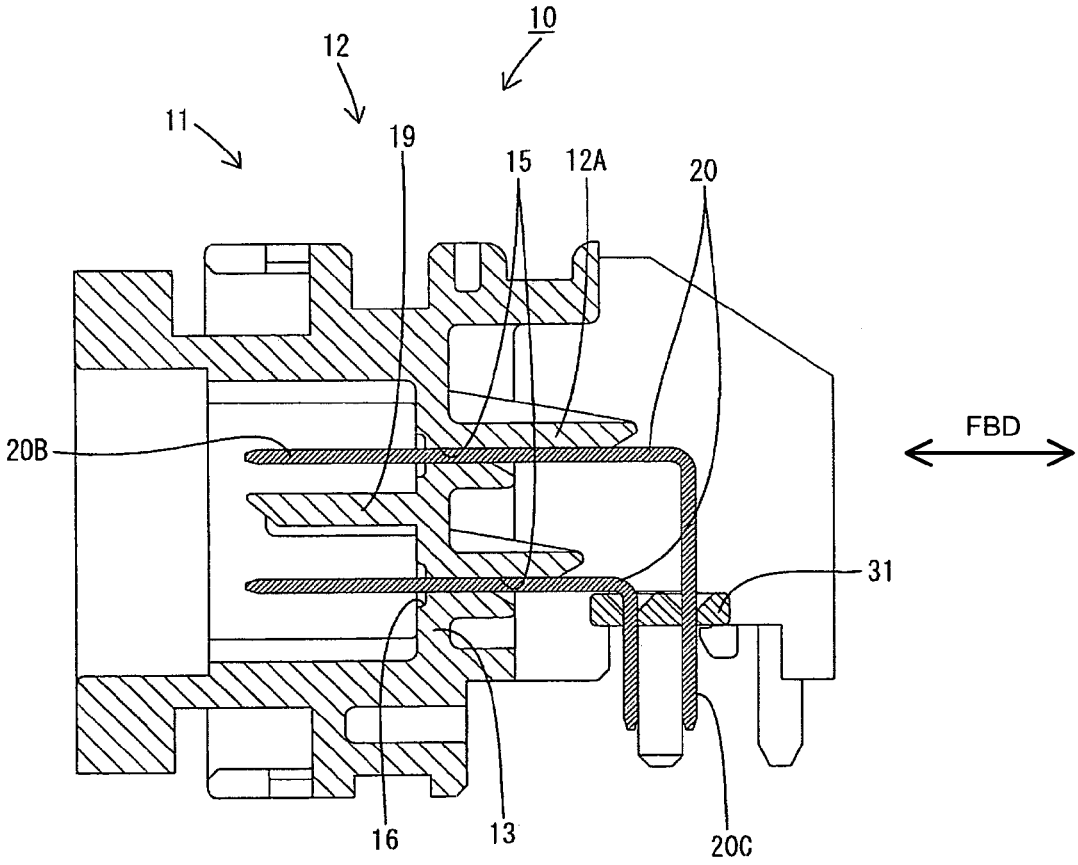
FIG. 1 is a longitudinal section of a connector according to one embodiment of the invention.
Figure 2:
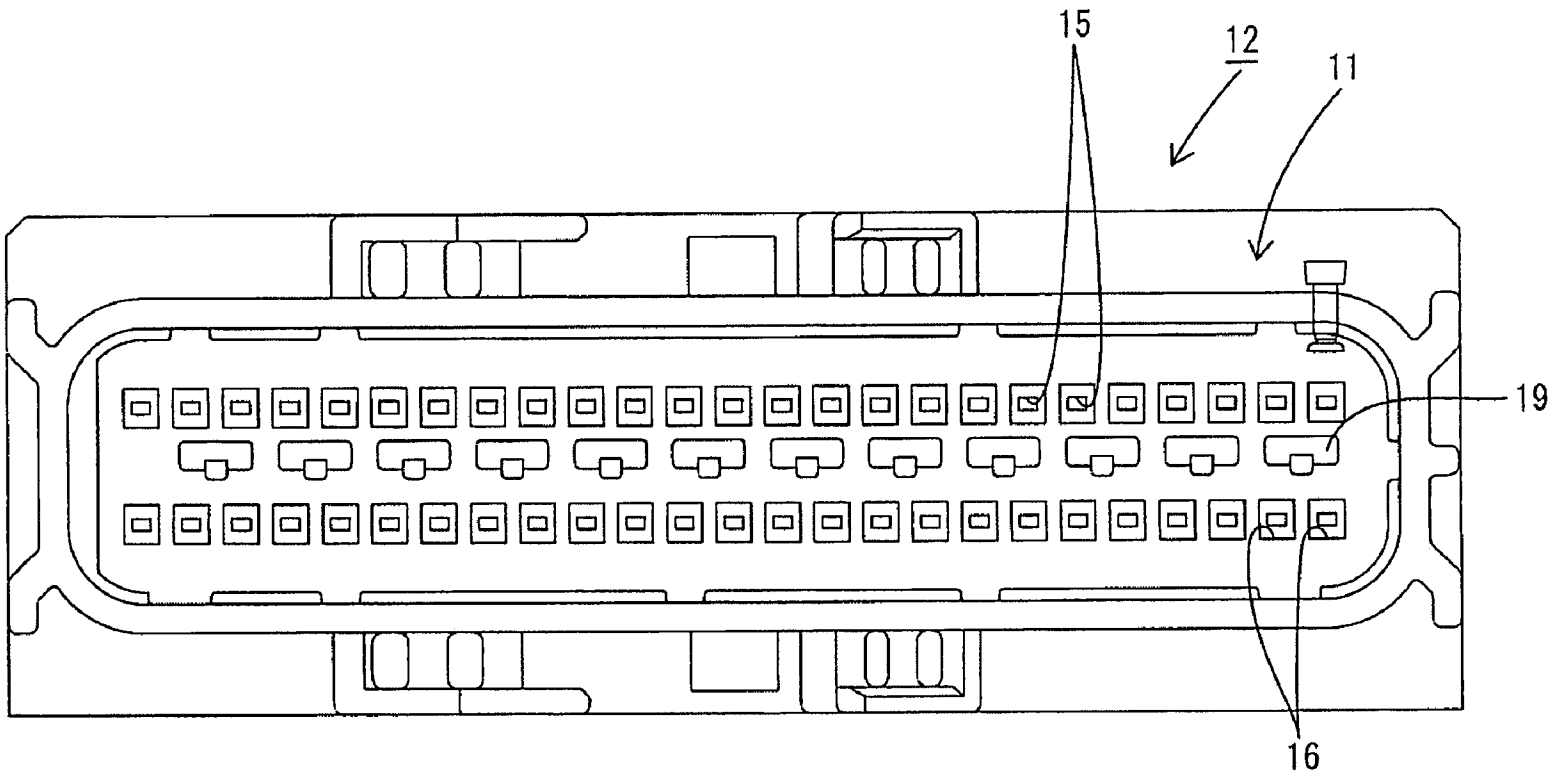
FIG. 2 is a front view of a connector housing showing a state before terminal fittings are inserted into insertion holes.
Figure 3:
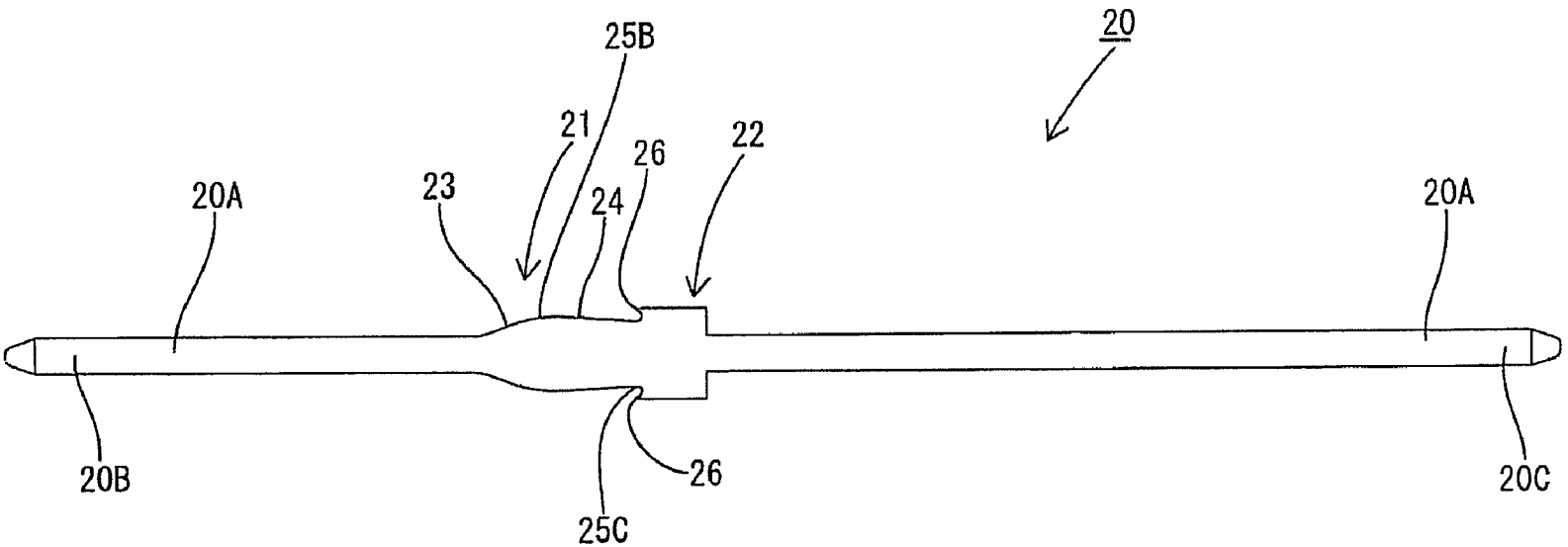
FIG. 3 is a plan view of the terminal fitting.
Figure 4:
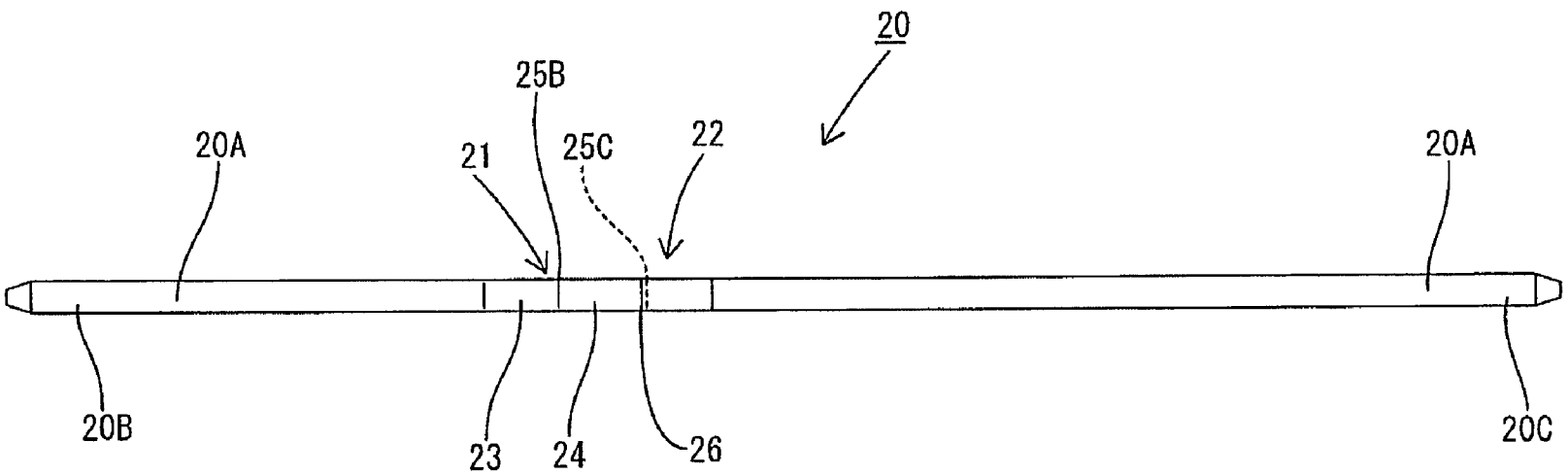
FIG. 4 is a side view of the terminal fitting.

The connector 10 includes a housing 12 that is formed unitarily from a synthetic resin, as shown in FIGS. 1 and 2. The housing 12 has opposite front and rear ends and a receptacle 11 extends into the front end.

A back wall 13 is formed at the rear of the receptacle 11, and insertion holes 15 penetrate the back wall 13 at upper and lower stages. The insertion holes 15 extend along forward and backward directions FBD.

Each insertion hole 15 has a substantially rectangular cross section with four substantially planar surfaces aligned parallel with the center axis of the respective insertion hole 15. However, each insertion hole 15 has a tapered front portion 15A of reduced cross section. A substantially rectangular recess 16 is formed at the front exit end of the insertion hole 15 and is cross-sectionally larger than the insertion hole 15. The recess 16 collects resin shavings or particles produced by abrasion or scratching as the terminal fitting 20 is pressed into the insertion hole 15, thereby preventing the shavings from coming out. A substantially rectangular introducing hole 18 is formed at the rear end of the insertion hole 15 and has a larger cross sectional area than the insertion hole 15.

Three out of the four surfaces of each introducing hole 18 excluding the upper surface are slanted to widen the introducing hole 18 towards the back. The upper surface of the introducing hole 18 extends back substantially parallel to the forward and backward directions FBD.

Stepping surfaces 17 extend out from the rear end 15RE of the insertion hole 15 to the surfaces of the introducing hole 18. The stepping surfaces 17 extend at substantially right angles to the forward and backward directions FBD.

Forcible connection preventing tabs 19 project forward from the back wall 13 substantially in correspondence with each pair of adjacent insertion holes 15 and between the insertion holes 15 at the upper stage and those at the lower stage. The forcible connection preventing tabs 19 guide the connection the connector 10 with a mating connector (not shown) so that both housings are connected at a substantially proper positional relationship.

The connector 10 also includes terminal fittings 20, each of which is made of a conductive metallic bar material. A terminal connecting portion 20B is formed at the front of each terminal fitting 20 and is configured for connection with a terminal fitting (not shown) of the mating connector. A board connecting portion 20C is formed at the rear of each terminal fitting 20 and is configured for connection with the circuit board, as shown in FIGS. 3 to 7, or with a wire (not shown). The board connecting portion 20C is bent down at an angle, preferably substantially by 90°, as shown in FIG. 1, when the terminal fitting 20 is in mounted in the housing 13.

An inserting portion 21 is formed at intermediate part of each terminal fitting 20 and is configured to be inserted into the insertion hole 15 substantially in the inserting direction ID. A bulge 22 is formed behind the inserting portion 21 and is configured to be accommodated in the introducing hole 18.

The inserting portion 21 is slightly shorter than the insertion hole 15 of the housing 12. A press-in portion 23 is formed at substantially a front half of the inserting portion 21 and is defined by two slanted surfaces 23A that diverge towards the back. An accommodating portion 24 is formed at a substantially rear half of the inserting portion 21. The accommodating portion 24 is continuous with the press-in portion 23 and is defined by two slanted surfaces 24A that converge moderately towards the back.

Figure 6:
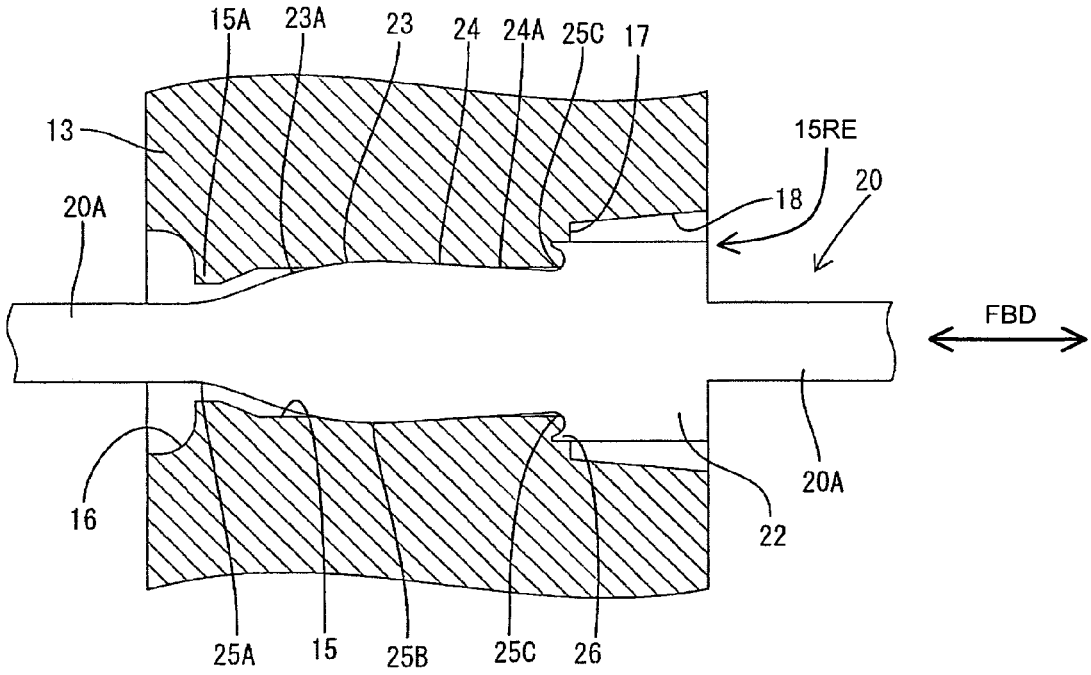
FIG. 6 is a plan view in section enlargedly showing a state where the terminal fitting is inserted in the insertion hole.
Figure 7:
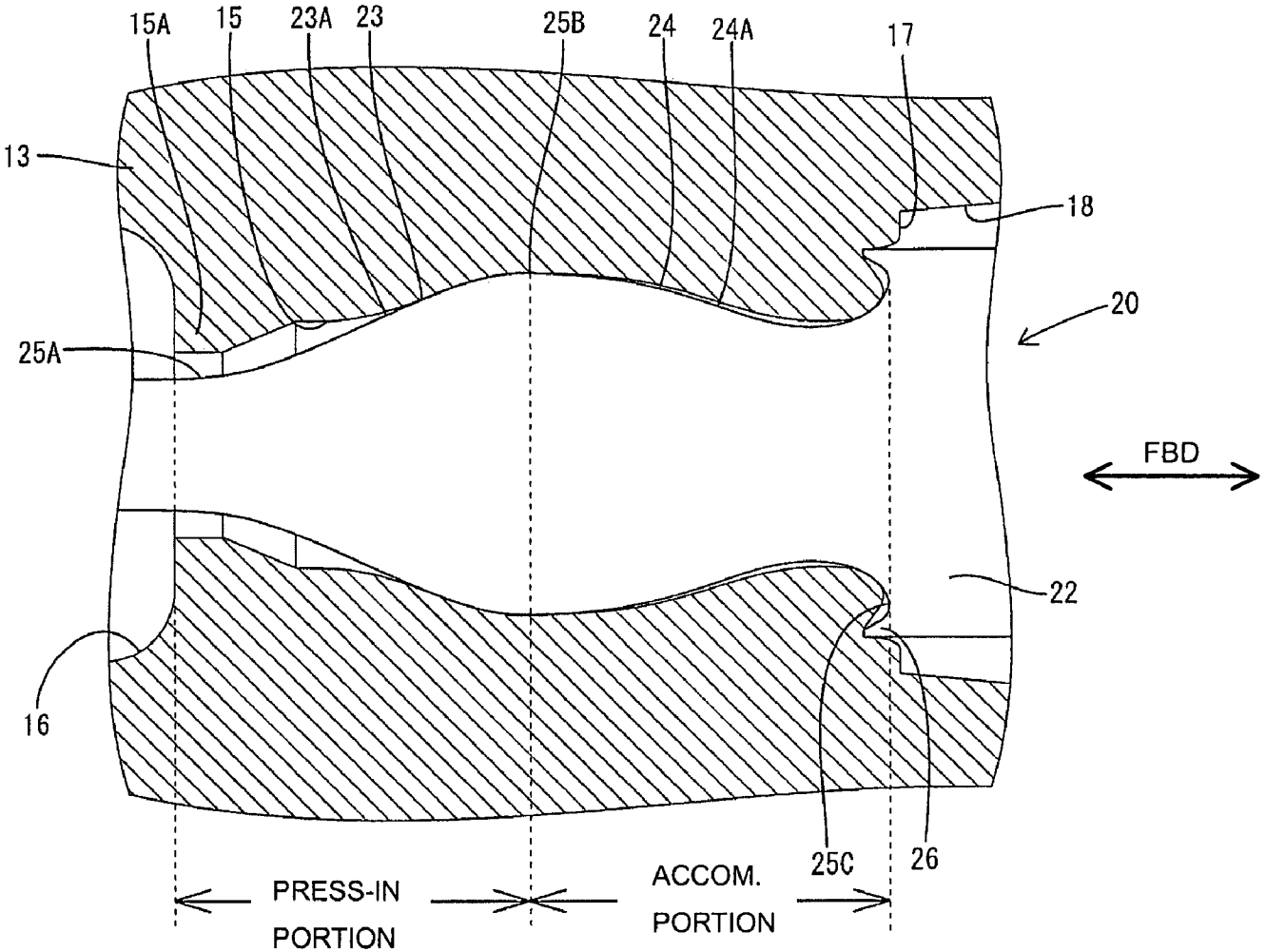
FIG. 7 is a conceptual plan view in section showing the state where the terminal fitting is inserted in the insertion hole.
Figure 8:
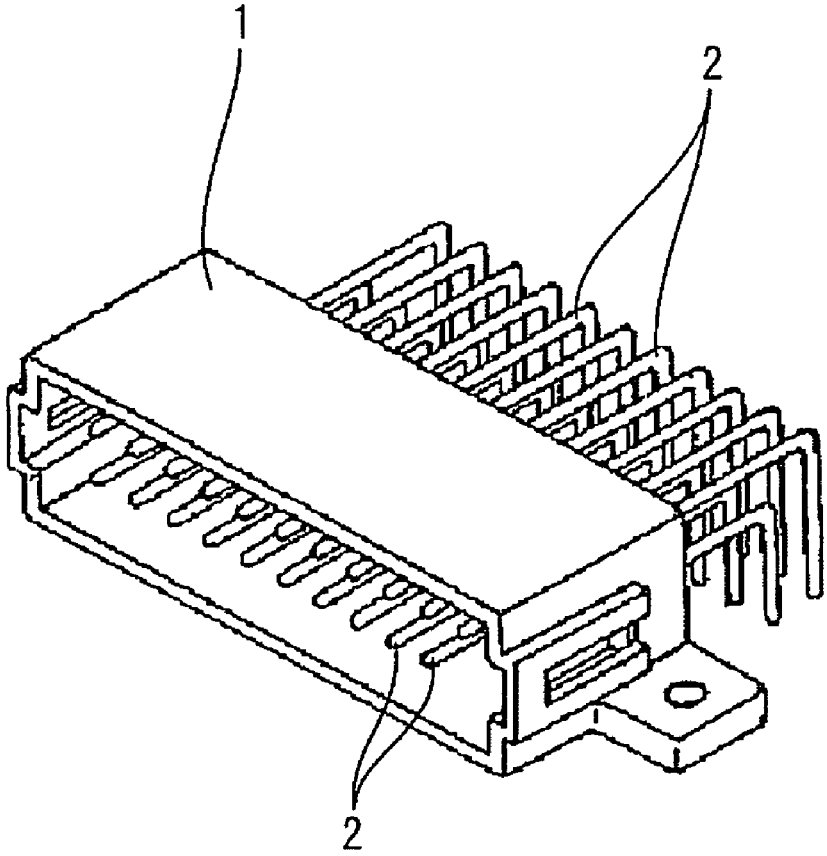
FIG. 8 PRIOR ART
FIG. 8 is a perspective view of a prior art connector.

FIGS. 6 and 7 show the terminal fitting 20 that has been pressed into the housing 12. As shown in FIG. 6, the terminal fitting 20 has a portion 20A of substantially constant rectangular cross section that extends from the front end of the terminal fitting 20 to a position 25A slightly behind the recess 16. The inserting portion 21 extends rearward from the position 25A and becomes gradually wider towards the back due to the diverging slanted surfaces 23A. The inserting portion 21 reaches a maximum width slightly larger than the width of the insertion hole 15 near a center 25B of the inserting portion 21 and the rear of the press-in portion 23. The inserting portion 21 then becomes gradually narrower due to the converging slanted surfaces 24A of the accommodating portion 24. The accommodating portion 24 is slightly narrower than the insertion hole 15 at a portion 25C at the front end of the bulge 22 and near the stepping surfaces 17. The inclination of the slanted surfaces 24A preferably is more moderate than the inclination of the slanted surfaces 23A.

Movement of the terminal fitting 20 into the insertion hole 15 causes a part of the press-in portion 23 that is wider than the insertion hole 15 to push material defining the insertion hole 15 outward. At least part of the pushed-out material then returns towards the accommodating portion 24 to be accommodated around the accommodating portion 24.

The bulge 22 is substantially continuous with the rear end of the inserting portion 21. Additionally, biting projections 26 project forward at opposite widthwise sides of the front end of the bulge 22 and are joined to the accommodating portion 24 by arcuate recesses. The bulge 22 contacts the stepping surfaces 17 of the housing 12 to restrict the insertion position of the terminal fitting 20 when the terminal fitting 20 is pressed to a substantially proper insertion depth. The biting projections 26 at the front end of the bulge 22 then bite into the stepping surfaces 17 deform the material near the accommodating portion 24 towards the accommodating portion 24. The bulge 22 is accommodated in the introducing hole 18 so that a rear end surface 22B of the bulge 22 is substantially flush with the rear end surface of the back wall 13 when the terminal fitting 20 is pressed to the proper position. A portion 20A of substantially rectangular cross section of constant size continues behind the bulge 22 towards the board connecting portion 20C.

Figure 5:
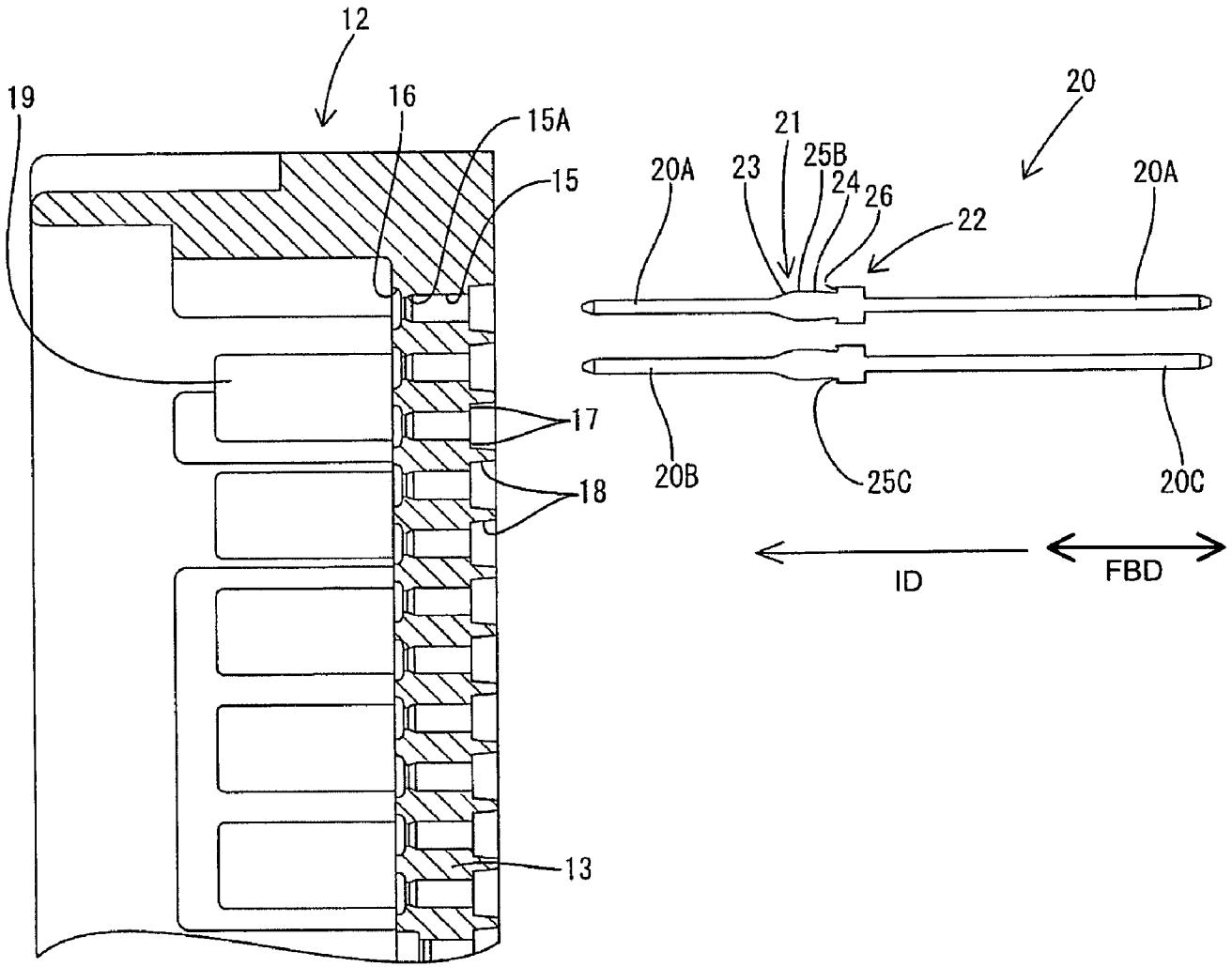
FIG. 5 is a plan view in section showing the insertion of the terminal fittings into the insertion holes.

The terminal connecting portion 20B of each terminal fitting 20 is inserted in the insertion direction ID into the entrance of the insertion hole 15 formed in the back wall 13 of the receptacle 11 from the rear side of the housing 12, as shown by an arrow in FIG. 5.

The rear part of the press-in portion 23 contacts opposite sides of the entrance of the insertion hole 15 as the terminal fitting 20 is inserted further into the insertion hole 15 and pushes the resin material of the housing 12 transversely out to widen the insertion hole 15. The accommodating portion 24 then enters the insertion hole 15 as the terminal fitting 20 is advanced further. The accommodating portion 24 converges gradually due to the slanted surfaces 24A at the opposite widthwise sides. Thus, the material pushed out by the press-in portion 23 returns after the passage of the press-in portion 23 to engage around the accommodating portion 24. The bulge 22 behind the accommodating portion 24 contacts the stepping surfaces 17 when the terminal fitting 20 reaches the proper insertion depth to prevent further insertion. As a result, the terminal fitting 20 is fixed at the proper insertion depth and the biting projections 26 bite into the stepping surfaces 17 to deform a part of the material near the accommodating portion 24 towards the accommodating portion 24.

Ends of the terminal fittings 20 that project back beyond the rear of the back wall 13 are bent down preferably at substantially right angles by a bending jig (not shown) after the terminal fittings 20 reach their proper positions. The bent rear portions then are introduced through an alignment plate 31 to achieve a specified pattern and are connected with the circuit board.

Pressure acts on the terminal fittings 20 in withdrawing direction when the connector 10 is connected with a mating connector (not shown). However, the material pushed out by the press-in portions 23 returns after passage of the press-in portions 23 to engage around the accommodating portions 24. This engagement of the returned material with the accommodating portions 24 prevents the withdrawal of the terminal fittings 20. The pushed-out material would not return sufficiently if the width of the inserting portions 21 at the portions 25C near the stepping surfaces 17 was larger than the width of the insertion holes 15. However, the accommodating portions 24 at the front ends of the bulges 22 are narrower than the insertion holes 15. Thus, the pushed-out material can return sufficiently.

Slanted surfaces 24A of the accommodating portion 24 would have a steeper inclination if the slanted surfaces 24A terminated at an intermediate position along the insertion hole 15. This hypothetical design would cause larger clearances between the returned material and the slanted surfaces 24A. As a result, this hypothetical accommodating portion 24 would not be caught sufficiently by the material, and would be less effective at resisting pressure on the terminal fitting 20 in withdrawing direction. However, the slanted surfaces 24A of the accommodating portion 24 extend substantially to the entrance of the insertion hole 15, and are sloped more moderately. Therefore, the accommodating portion 24 is caught sufficiently by the material to prevent the withdrawal of the terminal fitting 20 when a pressure acts on the terminal fitting 20 in withdrawing direction.

Further, the bulge 22 is formed with the biting projections 26 for engaging the stepping surfaces 17 and deforming the material towards the accommodating portion 24. Thus, the accommodating portion 24 can be caught more securely by the shifted material to prevent the backward withdrawal of the terminal fitting 20 when a pressure acts on the terminal fitting 20 in withdrawing direction.

The invention is not limited to the above described and illustrated embodiment, and the following embodiments also are embraced by the scope of the invention as defined by the claims. Various other changes can be made without departing from the scope of the invention as defined by the claims.

Although the connector 10 is a circuit board connector in the foregoing embodiment, the invention may be applied to other connectors such as wire to wire connectors, wire to junction box connectors, etc.

Although the rear end of the accommodating portion 24 of the terminal fitting 20 is narrower than the insertion hole 15 in the foregoing embodiment, it may be substantially the same width as the insertion hole 15.

The bulge 22 of the terminal fitting 20 has the biting projections 26 for pulling the material towards the accommodating portion 24. However, the terminal fitting 20 may have no biting projection 26 or several biting projections 26 circumferentially and/or longitudinally spaced.

The slanted surfaces 24A of the accommodating portion 24 converge towards the back and extend to the entrance of the insertion hole 15 in the foregoing embodiment. However, the slanted surfaces 21A may not extend to the entrance of the insertion hole 15 even though the illustrated embodiment shifts the material towards the accommodating portion 24 more effectively.

The terminal fittings 20 are inserted while being aligned at the upper and lower stages in the back wall 13 in the foregoing embodiment. However, the terminal fittings 20 may be at three or more stages in the back wall 13 or may be arranged at a different specified pattern.

Although the cross section of the insertion holes 15 in the back wall 13 is rectangular in the foregoing embodiment, they may have a circular, elliptical, polygonal or other shape according to the invention.

What is claimed is:

1. A terminal fitting to be pressed into an insertion hole of a housing of a connector, the terminal fitting comprising:

a press-in portion to be inserted into the insertion hole, the press-in portion being dimensioned to deform material of the housing outward; and an accommodating portion substantially continuous with the press-in portion and behind the press-in portion with respect to an insertion direction, the accommodating portion having at least one slanted surface converging towards an opposite surface of the accommodating portion to narrow the accommodating portion towards a rear side with respect to the inserting direction so that the material deformed out by the press-in portion returns after passage of the press-in portion to engage around at least part of the accommodating portion.

2. The terminal fitting of claim 1, wherein the accommodating portion has a minimum width no wider than the insertion hole.

3. The terminal fitting of claim 2, wherein the accommodating portion is narrower than the insertion hole.

4. The terminal fitting of claim 1, wherein the slanted surface of the accommodating portion extends along the inserting direction substantially to an entrance of the insertion hole.

5. The terminal fitting of claim 1, wherein the at least one slanted surface comprises two slanted surfaces converging towards one another at farther distances from the press-in portion.

6. The terminal fitting of claim 1, further comprising a bulge behind the accommodating portion with respect to the insertion direction, the bulge being wider than adjacent parts of the accommodating portion and wider than the insertion hole for restricting insertion of the terminal fitting at a proper insertion depth in the insertion hole.

7. The terminal fitting of claim 5, wherein the bulge has at least one biting projection projecting forward with respect to the insertion direction for biting in the housing and deforming the material of the housing towards the accommodating portion.

8. A connector, comprising:

a housing with at least one insertion hole penetrating a portion of the housing; and a terminal fitting having a press-in portion pressed into the insertion hole from an insertion side of the housing, the press-in portion being dimensioned to deform material of the housing transversely out from the terminal fitting, and an accommodating portion behind the press-in portion with respect to an insertion direction, the accommodating portion having at least one slanted surface formed to narrow the accommodating portion towards a rear side with respect to the inserting direction so as to let material of the housing pushed out by the press-in portion to return after passage of the press-in portion to engage around at least part of the accommodating portion.

9. The connector of claim 8, wherein the housing is formed from a resin material.

10. The connector of claim 9, wherein the accommodating portion is narrower than the insertion hole.

11. The connector of claim 10, further comprising a bulge behind the accommodating portion with respect to the insertion direction, the bulge being wider than adjacent parts of the accommodating portion and wider than the insertion hole for restricting insertion of the terminal fitting at a proper insertion depth in the insertion hole.

12. The connector of claim 11, wherein a step is formed at an entrance of the insertion hole and extends substantially transverse to an axis of the insertion hole.

13. The connector of claim 12, wherein the bulge has at least one biting projection projecting forward with respect to the insertion direction for biting in the step and deforming the material of the housing towards the accommodating portion.

14. The connector of claim 10, wherein the slanted surface of the accommodating portion extends along the inserting direction substantially to an entrance of the insertion hole.

15. The connector of claim 8, wherein the housing is formed unitarily from a resin material.

16. The connector of claim 8, wherein the accommodating portion is narrower than the insertion hole.

17. The connector of claim 8, wherein the housing comprises a receptacle for receiving a mating connector, the insertion hole penetrating a back wall of the receptacle.

* * * * *